US005758634A

United States Patent [19]

Ellison, Jr.

[11] Patent Number: 5,758,634

[45] Date of Patent: Jun. 2, 1998

[54] CONCRETE SHEARING METHOD

[76] Inventor: Russell P. Ellison, Jr., 109 Ralston Rd., Richmond, Va. 23229

[21] Appl. No.: 824,819

[22] Filed: Mar. 26, 1997

[51] Int. Cl.[6] ..... B28D 1/32

[52] U.S. Cl. ..... 125/23.01; 225/96

[58] Field of Search ..... 125/23.01; 225/96

[56] References Cited

U.S. PATENT DOCUMENTS

| | | | |
|---|---|---|---|
| 3,492,984 | 2/1970 | Harper | 125/23.01 |
| 3,817,236 | 6/1974 | Schlough | 125/23.01 |
| 3,974,842 | 8/1976 | Coffman | 125/23.01 |
| 4,048,977 | 9/1977 | Jenkins | 125/23.01 |

*Primary Examiner*—Robert A. Rose
*Assistant Examiner*—George Nguyen

[57] ABSTRACT

A method and apparatus for creating a step in the edge of a concrete block is presented. The method includes conveying the concrete block through a sawing station that saws a thin groove and leaves a thin strip of concrete near the edge of the block. The block is then conveyed through a shearing station that includes two rollers mounted to a bar. The inner distance between the outer periphery of the rollers is set to less than the thickness of the block and the resultant shear created by the roller arrangement shears the narrow strip of concrete from the block. The step created in the block is very even and rectangular in shape.

7 Claims, 2 Drawing Sheets

CONCRETE SHEARING METHOD

FIELD OF THE INVENTION

This invention relates to a method and apparatus for forming a step in a concrete block, and in particular, to an improved method and apparatus for forming a step wherein the amount of dust is minimized and most of the waste concrete is left in a usable form. The method consists of using a standard ⅛ inch thick masonry saw blade to form a groove in the block parallel with and near an edge of the block thereby creating a narrow strip of concrete along the edge of the block. Thereafter the block is passed through a dual wheel arrangement that applies a shear force causing the remaining strip of concrete to break into pieces that can be used commercially for other products.

BACKGROUND OF THE INVENTION

In the construction industry, when using joists to support concrete blocks in accordance with a new technology invented by the applicant, it is common to use a concrete block with a stepped edge. The step in the edge of a concrete block is typically ½ inch by ¾ inch but may be other sizes. These steps may be cast into the block when the block is manufactured, but it is sometimes more convenient to take a standard block and cut the steps into it. This reduces the size of the inventory required by stocking many different styles of blocks.

A couple of methods are commonly used to create a step in the edge of a concrete block. In the first method, for example, for a standard ½ inch by ¾ inch step, a ¾ inch deep cut is made down the side of the block, then the block is turned 90° and a second cut is usually made with a second saw that is set to cut ½ inch deep. In the second method, again for a standard ½ inch by ¾ inch step, a very expensive ½ inch wide diamond saw blade is used to make a ¾ inch deep cut. Both of the aforementioned methods are expensive and make a lot of sawdust, which is expensive waste.

Accordingly, as described by these several limitations, methods of cutting steps in the edges of concrete blocks have not proven fully satisfactory and may be improved by reducing the expense and the amount of sawdust created.

SUMMARY OF THE INVENTION

This invention provides an improved method for creating a step in the edge of a concrete block. The method involves making a ¾ inch deep cut with a relatively thin blade, for example a standard ⅛ inch thick blade, which leaves a inch by ¾ inch tall strip of concrete on the edge of the block. For making this cut, the saw blade is typically fixed and the block is rolled under the blade. To remove the ⅜ inch by ¾ inch strip of concrete, the block is then rolled through a set of rollers mounted at opposite ends of a rod and to rotate around axes which are parallel to each other. The rollers are set at something less than the thickness of the concrete block and positioned so as to put a shearing force at the base of the ⅜ inch by ¾ inch strip of concrete. This method results in a very rectangular ½ inch by ¾ inch step in the edge of the block with the pieces sheared off being of such a size that they could be used like crushed stone.

The improved method of this invention provides a rectangular shaped step of the proper size in a concrete block with the amount of energy expended and the sawdust produced both minimized and the with a waste product that could be utilized in construction.

OBJECTS AND ADVANTAGES

A principal object of the present invention is to provide a method of forming a step in a concrete block that will minimize the amount of sawdust that is created.

A second object of the present invention is to provide a method of forming a step in a concrete block that minimizes the amount of energy expended.

Another object of the present invention is to provide a method of forming a step in a concrete block that leaves most of the waste material in a useful form, for example as a substitute for crushed stone.

Other objects of the method of the present invention is that it is fast and doesn't require special handling of the concrete block, standard sawing equipment is used, and no special inventory must be kept for stepped blocks as the method allows them to easily be produced from standard blocks.

Other objects and advantages of the preferred embodiment will become apparent when reading the attached description of the invention and referring to the associated drawings

DESCRIPTION OF THE INVENTION

Figure 1:
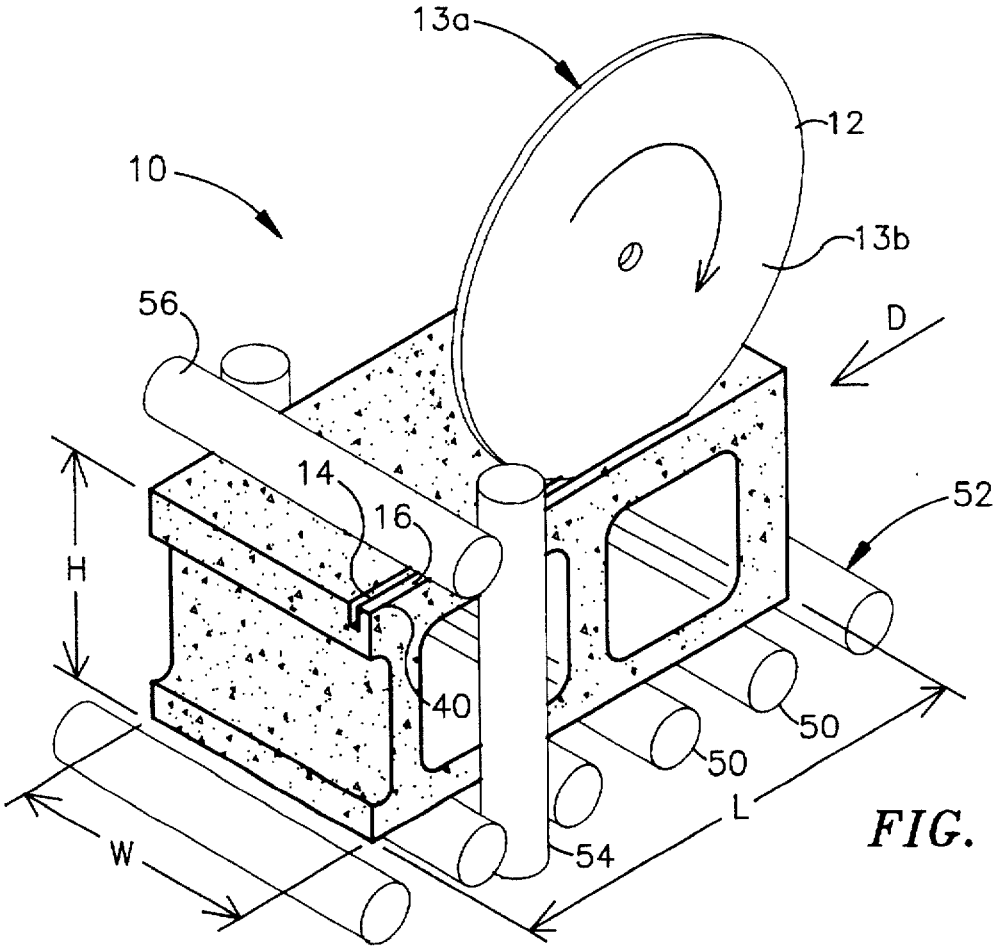
FIG. 1 is a perspective view of a concrete block being passed under a concrete saw to create a groove near the edge of the block.

The invention is a method and apparatus for creating a stepped edge in a concrete block. Referring now to FIG. 1, a standard concrete block 10 is shown passing under a thin saw blade 12 such as an abrasive masonry saw blade. The standard concrete block is denoted with a length, width and height. These dimensions for a typical concrete block would be a length of up to 24 inches and a width and height of up to 12 inches. The arrow D denotes the direction of travel of the block. The block 10 would be propelled on a conveyor mechanism such as a roller conveyor 52 which includes a plurality of horizontally disposed conveyor rollers 50 and the saw blade 12 would be rotating about a normally fixed position typically. A groove 14 is being created near the edge of the block by the saw blade as it is propelled through the blade 12. A strip 16 of tailing concrete is left where edge 40 remains on the block 10. A typical step size that would be desired in a concrete block would be ½ inch by ¾ inch. Therefore, referring again to FIG. 1, by cutting a ⅛ inch thick groove 14 to a depth of ¾ inch with a ⅛ inch thick saw blade 12 positioned with the inside edge **13*a* of the saw blade at a distance ½ inch from edge 40, a ⅜ inch by ¾ inch strip 16 of concrete remains at edge 40. The ⅜ inch thick strip 16 of concrete is the width of the strip left between the outer edge 13*b* of the saw blade 12 and edge 40** of the block.

In order to keep the block conveyed in a straight line, the conveyor mechanism includes a series of vertically disposed side alignment rollers 54 (only two of which are shown). Further, to keep the block from rising up, at least one horizontally disposed hold down roller 56 is included with the conveyor mechanism.

Figure 2:
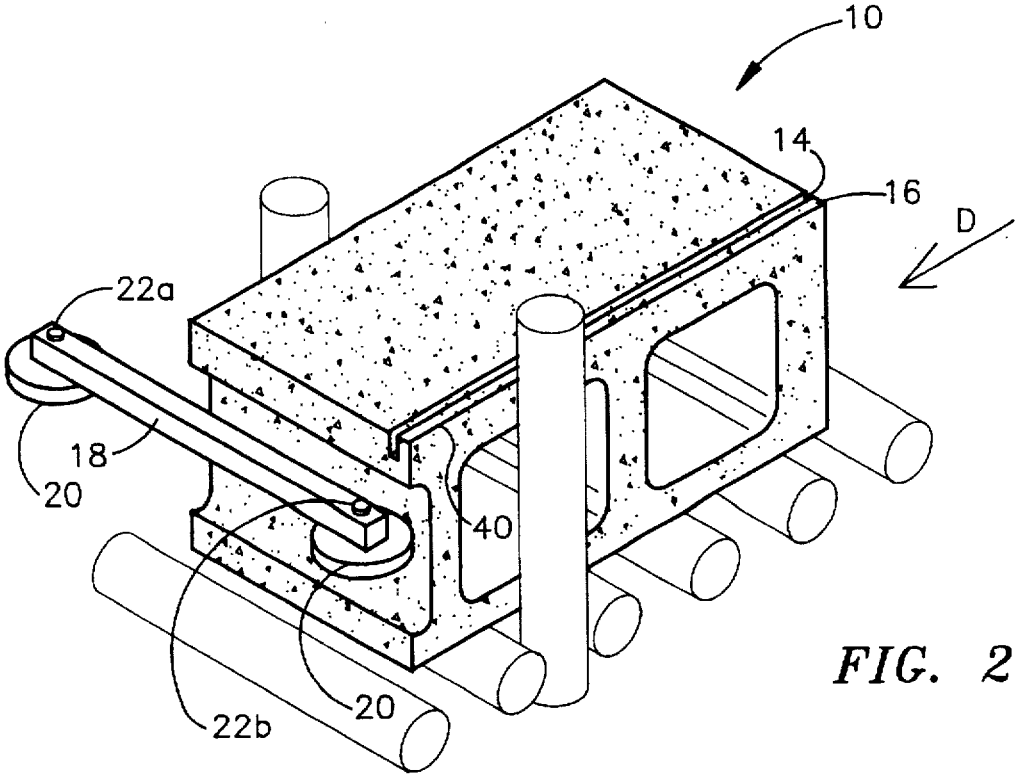
FIG. 2 is a perspective view of a concrete block nearing the point where it will be passed between two fixed rollers one of which will apply a shear force to shear the concrete remaining between the groove and the edge of the block.

FIG. 2 is a perspective view of the concrete block 10 after the groove 14 has been cut along the entire length of the block leaving a ⅜ inch by ¾ inch concrete strip 16 between groove 14 and edge 40. FIG. 2 depicts the concrete block 10 as it would be after being propelled through the saw blade and farther on the conveyor, still moving in direction D as shown by the arrow. Also shown in FIG. 2 is the next apparatus that comprises this invention, a shearing station, which includes a bar 18 having two rollers 20 mounted such that they are free to rotate on separate shafts 22*a* and 22*b*

Figure 3:
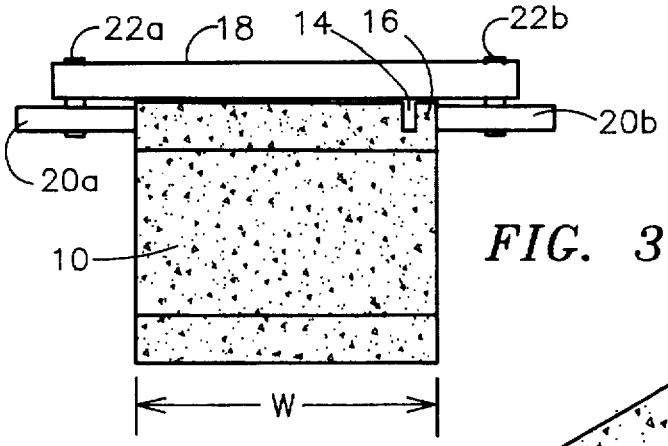
FIG. 3 shows an end view of the concrete block as it begins to roll through the fixed rollers.

FIG. 3 is an end view of the concrete block 10 as it reaches the shearing station, showing the bar 18 with two rollers 20*a*, 20*b* each mounted on their respective shafts 22*a*, 22*b*. On the left side of FIG. 3, guide roller 20*a* is positioned on guide shaft 22*a* on bar 18 and its purpose is to guide the block through the shearing station. As the block 10 moves through the shearing station it will be forced to travel between guide roller 20*a* and shear roller 20*b*. As the block is propelled by the conveyor (not shown) into the shearing station, it also makes contact, as shown in the right side of FIG. 3, with the shear roller 20*b* which is rotatably attached by shear shaft 22*b* to bar 18. The distance between the rim of the guide roller 20*a* and the shear roller 20*b* is 1/16" to ⅛" less than the width of the block typically. As the block 10 is propelled between the rollers 20*a* and 20*b* which are spaced closer than the width of the block, a force is applied inwardly by the rollers 20*a* and 20*b* against the sides of the block.

Figure 4:
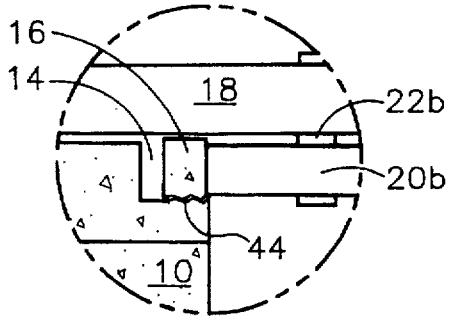
FIG. 4 is a detail of the right roller in FIG. 3 which is the roller that is applying the shear force to the strip of concrete between the groove and the edge.

The net effect of the force applied to the concrete block 10 is shown in FIG. 4. A thin strip 16 of concrete, ⅜ inch thick, is so limited in shear strength that the force applied by the shear roller 20*b* causes a fracture line 44 to develop at point 44 in FIG. 4. This fracture line 44 is the point at which the shear is developed by the force of the shear roller 20*b* on the block 10. As shown in FIG. 4, the fracture line 44 is even with the bottom of groove 14. As the concrete block 10 is propelled through the shearing station, concrete strip 16 is sheared off at fracture lane 44.

Figure 5:
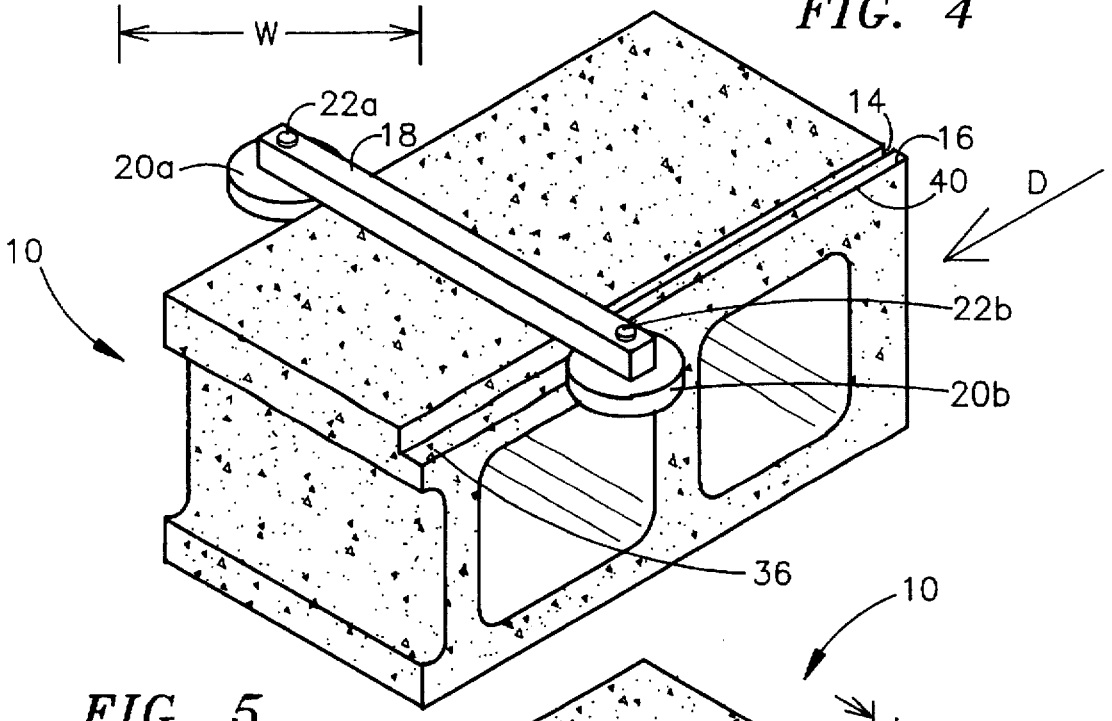
FIG. 5 is a perspective view of a concrete block after it has passed partially through the roller arrangement, with the portion of the strip that has passed through the roller sheared off.

FIG. 5 is a perspective view of the concrete block 10 as it is approximately half way through the shearing station and being propelled down a conveyor (not shown) in the direction given by the arrow denoted by the letter D. As shown in the figure, the edge 40 of block 10 has been sheared off by the shearing station consisting of the bar 18 with guide roller 20*a* mounted on guide shaft 22*a* and shear roller 20*b* mounted on shear shaft 22*b*. The force exerted by the shear roller 20*b* shears the ⅜ inch thick strip 16 of concrete from the block 10. As shown in FIG. 5, after the strip 16 is sheared off by the shearing station, a very nice rectangular ½ by ¾ inch step 36 is created in the block.

Figure 6:
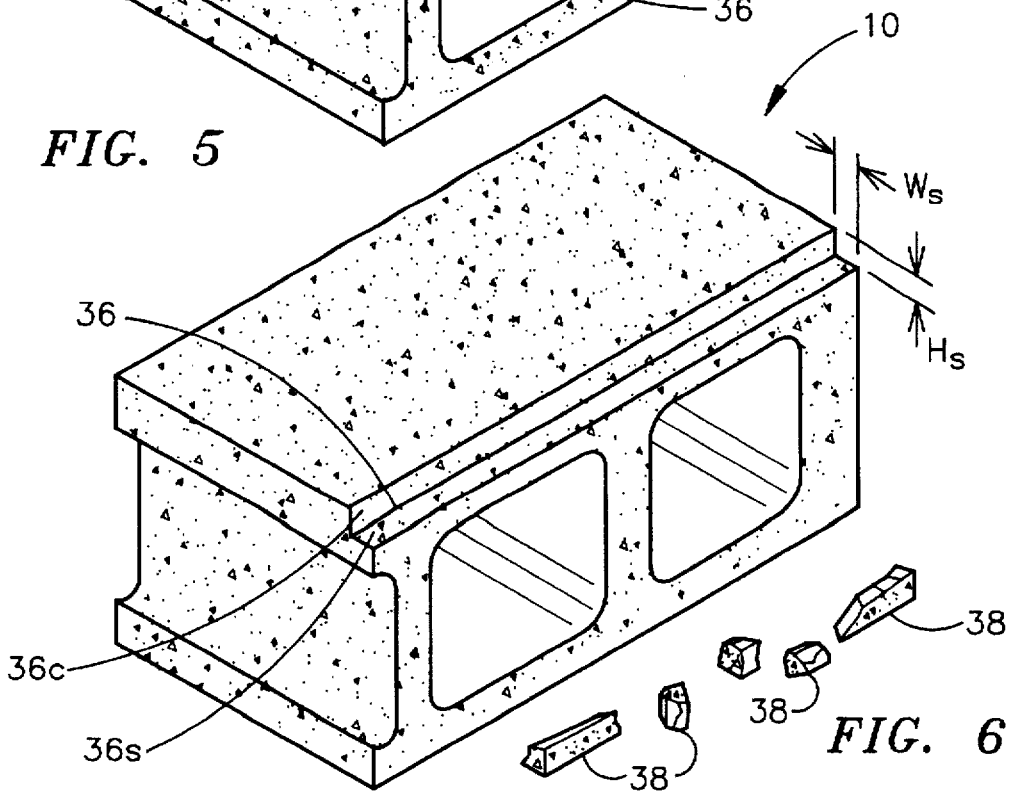
FIG. 6 is a perspective view of the finished stepped block, with the rectangular step in the edge of the block and the remaining chips which are useful as construction material.

FIG. 6 gives a perspective view of the finished block 10, with the step 36 formed in the edge of the block by the concrete shearing device described in this disclosure. The step has a width of ½ inch as denoted by $W_s$ and height of ¾ inch as denoted by $H_s$. The rectangular step 36 is shown having a cut surface 36*c* and a sheared surface 36*s*. The sheared surface 36*s* consists of one portion, ⅛ inch wide, nearest the juncture of surfaces 36*c* and 36*s* that was formed by the saw blade as it cut a groove in the block. The outer portion of the sheared surface 36*s*, that portion nearest side 46 of the block 10, was formed by the shearing station. As shown in FIG. 6, usable concrete chips 38 are produced.

What is claimed is:

1. A method for creating a step in a concrete block, including:

providing a concrete block having a first side, a first adjacent side and a second adjacent side;

providing a conveying system for said concrete block;

conveying said concrete block with said conveying system;

providing a sawing station;

sawing a narrow groove at a set depth in said first side parallel with and near said first adjacent side of said block, said narrow groove defining a narrow strip of concrete on said block;

providing a shearing station;

conveying said concrete block through said shearing station; and shearing said narrow strip of concrete with said shearing station to form a step at the edge of said concrete block between said first side and said first adjacent side.

2. The method of claim 1 wherein said sawing station includes a thin rotating saw blade fixed in a position to cut said narrow groove.

3. The method of claim 1 wherein said shearing station includes two rollers rotatably mounted to two shafts at opposite ends of a bar, said rollers including a first roller positioned to contact said first adjacent side and a second roller positioned to contact said second adjacent side, said rollers being mounted on said bar such that the inner distance between said rollers is less than the width of said concrete block across said first side, said rollers fixed in a position to enable said rollers to contact said concrete block on said adjacent sides, said rollers positioned at said depth of said groove.

4. A method for creating a step in a concrete block, including:

providing a concrete block having a first side, a first adjacent side and a second adjacent side;

providing a conveying system for said block;

conveying said concrete block through a sawing station wherein a thin rotating saw blade is fixed in a position to cut a narrow groove of a set depth and a set width in said first side, said groove being parallel with and near said first adjacent side, said groove of said depth defining a narrow strip of concrete remaining on said first side near said first adjacent side;

conveying said concrete block through a shearing station wherein two rollers are rotatably mounted to two shafts at opposite ends of a bar, said rollers including a first roller positioned to contact said first adjacent side and a second roller positioned to contact said second adjacent side, said rollers being mounted on said bar such that the inner distance between the said rollers is less than the width of said concrete block across said first side, said rollers furthermore positioned at said depth of said groove; and shearing said narrow strip of concrete by a shearing force caused by said shearing station to form a step at the edge of said concrete block between said first side and said first adjacent side.

5. A shearing device for creating a step in a concrete block having a first side, a first adjacent side and a second adjacent side, including:

a conveying system for said concrete block;

a sawing station which includes a thin rotating saw blade fixed in a position to cut a narrow groove of a set depth and a set width in said first side, said groove being parallel with and near said first adjacent side, said groove of said depth defining a narrow strip of concrete remaining on said first side near said first adjacent side; and a shearing station which includes two rollers rotatably mounted to two shafts at opposite ends of a bar, said rollers including a first roller positioned to contact said first adjacent side and a second roller positioned to contact said second adjacent side, said rollers being mounted on said bar such that the inner distance between said rollers is less than the width of said concrete block across said first side, said rollers furthermore positioned at said depth of said groove.

6. The shearing device of claim 5 wherein:

said depth of said groove is typically ¾ inch;

said width of said groove is typically ⅛ inch;

said narrow strip of concrete remaining of said first side is typically ⅜ inch thick; and said inner distance between said rollers is typically 1/16 to ⅛ inches less than the width of the block.

7. The method of claim 4 wherein said narrow strip of concrete is converted by said shearing station to usable concrete chips.

* * * * *